US010479648B2

(12) United States Patent
Sudi et al.

(10) Patent No.: US 10,479,648 B2
(45) Date of Patent: Nov. 19, 2019

(54) AUTOMATIC ELEVATOR INSPECTION SYSTEMS AND METHODS

(71) Applicant: Otis Elevator Company, Farmington, CT (US)

(72) Inventors: Sandeep Sudi, Unionville, CT (US); Daniel M. Tripp, Sr., Deerfield, NH (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 299 days.

(21) Appl. No.: 15/593,424

(22) Filed: May 12, 2017

(65) Prior Publication Data

US 2018/0327218 A1 Nov. 15, 2018

(51) Int. Cl.
*B66B 5/00* (2006.01)
*B66B 9/00* (2006.01)

(52) U.S. Cl.
CPC ..... *B66B 5/0025* (2013.01); *B66B 5/0031* (2013.01); *B66B 5/0087* (2013.01); *B66B 9/00* (2013.01)

(58) Field of Classification Search
CPC .... B66B 5/0025; B66B 5/0031; B66B 5/0087
USPC ..... 187/393
See application file for complete search history.

(56) References Cited

U.S. PATENT DOCUMENTS 3,326,326 A * 6/1967 Fink ..... B66B 5/06 187/287
5,135,081 A 8/1992 Watt et al.
6,435,315 B1 8/2002 Zaharia
6,612,403 B2 9/2003 Silberhorn et al.
7,650,970 B2 1/2010 Lelic et al.
8,540,057 B2 * 9/2013 Schuster ..... B66B 1/34 187/247
8,857,572 B2 10/2014 Leutenegger et al.
8,960,376 B2 2/2015 De Coi
9,352,934 B1 5/2016 Lee
9,399,562 B2 7/2016 Terry et al.
9,469,501 B2 10/2016 Lee
9,963,323 B2 * 5/2018 Liu ..... B66B 5/0037
(Continued)

FOREIGN PATENT DOCUMENTS

CN 201473135 5/2010
CN 102405182 A 4/2012
(Continued)

OTHER PUBLICATIONS

European Search Report, European Application No. 18171926.1, dated Oct. 16, 2018, EP Patent Office; EP Search Report 8 pages.
(Continued)

*Primary Examiner* — David S Warren
(74) *Attorney, Agent, or Firm* — Cantor Colburn LLP

(57) ABSTRACT

Elevator systems and methods of operating elevator systems having an elevator car within an elevator shaft, a counterweight within the elevator shaft and operably connected to the elevator car, an indicator element located in a pit of the elevator shaft, and an inspection system including a detector located on the elevator car and arranged to detect a location of the counterweight in an inspection region within the pit based a relative position between the counterweight and the indicator element.

18 Claims, 6 Drawing Sheets

(56) References Cited

U.S. PATENT DOCUMENTS

| | | | | |
|---|---|---|---|---|
| 2006/0232789 | A1* | 10/2006 | Oh | B66B 1/3492 356/614 |
| 2008/0156591 | A1 | 7/2008 | Tracey | |
| 2013/0015022 | A1* | 1/2013 | Sonnenmoser | B66B 1/3492 187/394 |
| 2013/0015238 | A1* | 1/2013 | Studer | B66B 1/3492 235/375 |
| 2018/0327218 | A1* | 11/2018 | Sudi | B66B 9/00 |

FOREIGN PATENT DOCUMENTS

| | | | |
|---|---|---|---|
| CN | 103058039 | | 4/2013 |
| CN | 103322930 | | 9/2013 |
| CN | 105026297 | A | 11/2015 |
| CN | 105173949 | | 12/2015 |
| JP | H03186584 | A | 8/1991 |
| JP | H06263352 | A | 9/1994 |
| JP | H07206341 | | 8/1995 |
| JP | H1192056 | A | 4/1999 |
| JP | 2005170573 | A | 6/2005 |
| JP | 2010280466 | A | 12/2010 |
| JP | 5278146 | | 9/2013 |
| JP | 2014076871 | | 5/2014 |
| WO | 2015118064 | | 8/2015 |

OTHER PUBLICATIONS

He, Ruo quan et al., "Elevator on-site inspection work guidelines—traction and forces the driver elevator", Henan Medical University Press, 2000, ISBN 9787564505219.

* cited by examiner

AUTOMATIC ELEVATOR INSPECTION SYSTEMS AND METHODS

BACKGROUND

The subject matter disclosed herein generally relates to elevator systems and, more particularly, elevator inspection systems and methods.

Various components and features of elevator systems require inspection in order to comply with elevator code(s). Such components and features can include brakes, cables, locks, actuators, etc.

For example, elevator systems have counterweights that are used to enable movement of an elevator car within an elevator shaft. The counterweight may have requirements of minimum travel distances from a bottom or floor of a pit. The minimum travel distance may require inspection to ensure compliance with elevator code(s). For example, fatigue or stretching of roping can enable a counterweight to exceed the minimum travel distance. It may be advantageous to enable improved inspection techniques for counterweights of elevator systems.

SUMMARY

According to some embodiments, elevator systems are provided. The elevator systems include an elevator car within an elevator shaft, a counterweight within the elevator shaft and operably connected to the elevator car, an indicator element located in a pit of the elevator shaft, and an inspection system having a detector located on the elevator car and arranged to detect a location of the counterweight in an inspection region within the pit based a relative position between the counterweight and the indicator element.

In addition to one or more of the features described herein, or as an alternative, further embodiments of the elevator systems may include a counterweight guard located in the pit of the elevator shaft, the counterweight guard having the indicator element located thereon.

In addition to one or more of the features described herein, or as an alternative, further embodiments of the elevator systems may include that the inspection system further comprises a movable frame having a marker that is movable in response to interaction with the counterweight, the marker located proximate the indicator element In addition to one or more of the features described herein, or as an alternative, further embodiments of the elevator systems may include that the movable frame comprises a first side and a second side, wherein the inspection system comprises a contact surface on the first side, wherein the contact surface is arranged to interact with the counterweight and the marker is located on the second side.

In addition to one or more of the features described herein, or as an alternative, further embodiments of the elevator systems may include that a relative position of the marker and the indicator element indicates a distance of travel of the counterweight.

In addition to one or more of the features described herein, or as an alternative, further embodiments of the elevator systems may include that the inspection system further includes a support frame upon which the movable frame moves.

In addition to one or more of the features described herein, or as an alternative, further embodiments of the elevator systems may include a control unit in communication with the detector and configured to analyze an output of the detector, determine if the counterweight has an error, and generate an error notification when an error in the counterweight is determined.

In addition to one or more of the features described herein, or as an alternative, further embodiments of the elevator systems may include that the detector captures images of the indicator element for inspection.

In addition to one or more of the features described herein, or as an alternative, further embodiments of the elevator systems may include that the indicator element is at least one of a colored paint, a textured surface, or a reflective surface of at least one an elevator shaft wall or a counterweight guard.

In addition to one or more of the features described herein, or as an alternative, further embodiments of the elevator systems may include that the detector is located on an exterior of the elevator car.

In addition to one or more of the features described herein, or as an alternative, further embodiments of the elevator systems may include that the indicator element is arranged to determine if the counterweight exceeds a minimum counterweight clearance distance.

According to some embodiments, methods for inspecting counterweights of elevator systems are provided. The methods include moving a counterweight to a lowest position within an elevator shaft, observing an inspection region using a counterweight inspection system having a detector located on an exterior of an elevator car, the inspection region being a region including an indicator element, determining if an error exists with the counterweight based on the indicator element within the inspection region, and generating an error notification when an error in the counterweight is determined.

In addition to one or more of the features described herein, or as an alternative, further embodiments of the methods may include analyzing, with a control unit, an output of the detector.

In addition to one or more of the features described herein, or as an alternative, further embodiments of the methods may include that the indicator element is mounted to at least one of a counterweight guard or wall of the elevator shaft.

In addition to one or more of the features described herein, or as an alternative, further embodiments of the methods may include capturing images of the marker and the indicator element for inspection.

In addition to one or more of the features described herein, or as an alternative, further embodiments of the methods may include that the indicator element is at least one of a colored paint, a textured surface, or a reflective surface of at least one an elevator shaft wall or a counterweight guard.

In addition to one or more of the features described herein, or as an alternative, further embodiments of the methods may include that the detector is located on a bottom of the elevator car.

In addition to one or more of the features described herein, or as an alternative, further embodiments of the methods may include a movable frame having a marker positioned relative to the indicator element, wherein the movable frame comprises a first side and a second side, wherein the inspection system comprises a contact surface on the first side, wherein the contact surface is arranged to interact with the counterweight and the marker is located on the second side.

In addition to one or more of the features described herein, or as an alternative, further embodiments of the methods may include that a relative position of the marker and the indicator element indicates a distance of travel of the counterweight.

In addition to one or more of the features described herein, or as an alternative, further embodiments of the methods may include that the indicator element is arranged to determine if the counterweight exceeds a minimum counterweight clearance distance.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
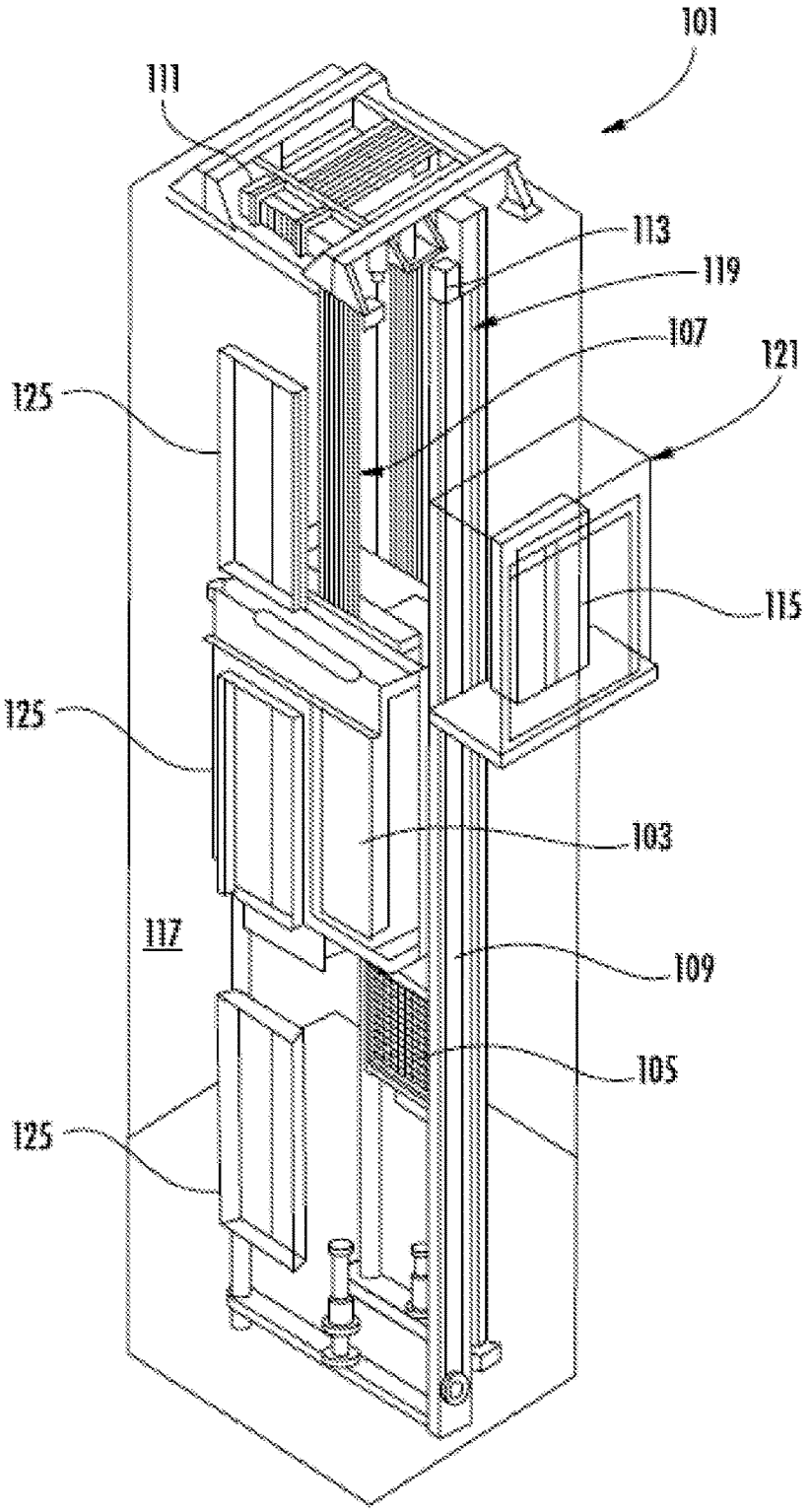
FIG. 1 is a schematic illustration of an elevator system that may employ various embodiments of the present disclosure.

As shown and described herein, various features of the disclosure will be presented. Various embodiments may have the same or similar features and thus the same or similar features may be labeled with the same reference numeral, but preceded by a different first number indicating the figure to which the feature is shown. Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Elevators are subject to inspection and monitoring to comply with elevator code requirements. However, inspection, monitoring, associated repairs, etc. can be time consuming. Accordingly, it may be advantageous to develop systems, devices, and processes to improve the efficiency of inspection and monitoring of various components, features, operations, etc. of elevator systems. For example, in accordance with embodiments of the present disclosure, systems and processes are provided to reduce the time needed to inspect and/or maintain elevators and/or to automatically perform inspections and/or monitoring operations.

One component of note for inspection and ensuring proper operation is a counterweight. Counterweights of elevator systems can be an essential element to ensure that proper operation of the elevator is achieved. The counterweight is used to enable movement of the elevator car within the elevator shaft. When an elevator car is located at the highest landings, the counterweight is located at the lowest position, and within the pit.

Figure 2:
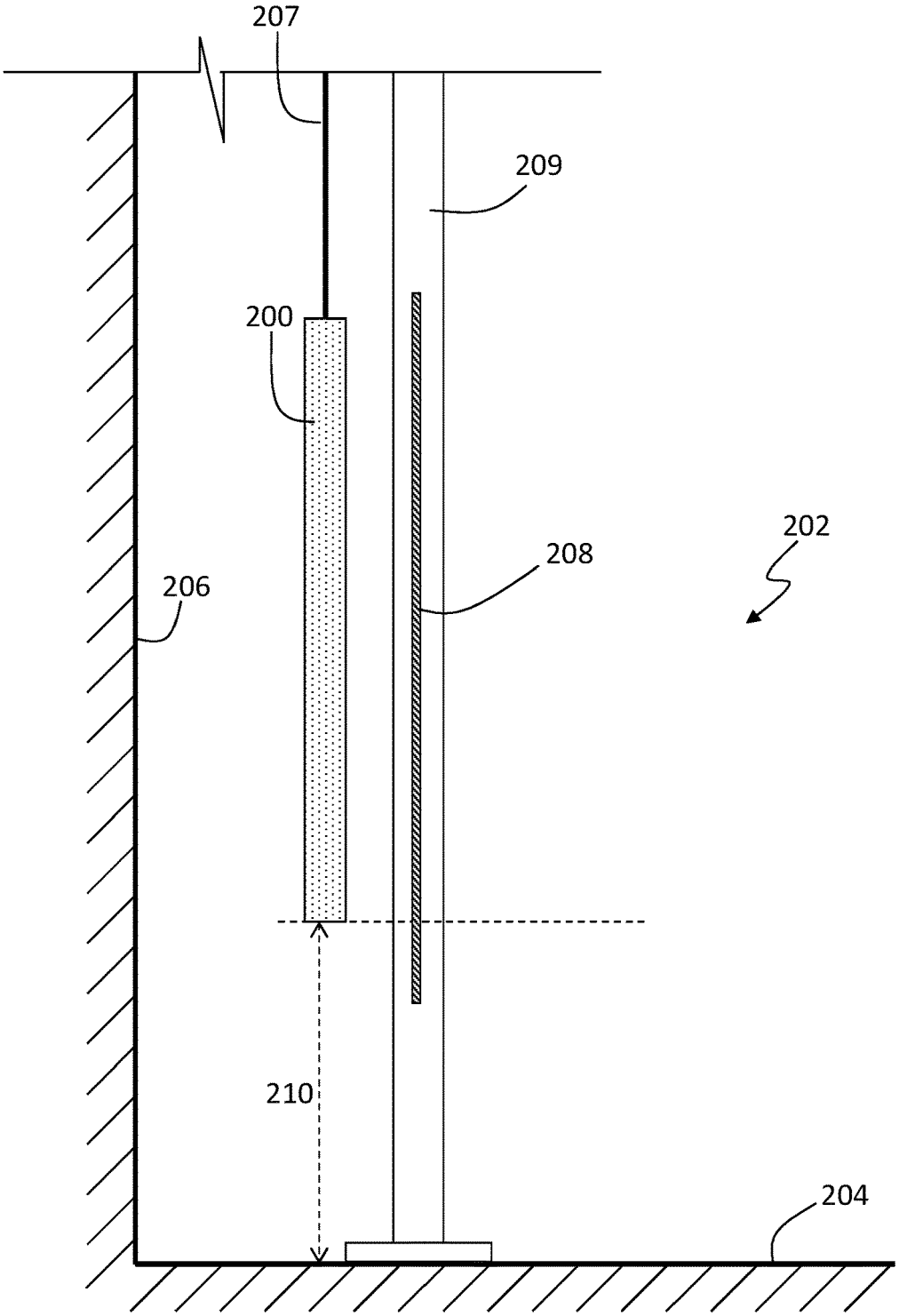
FIG. 2 Prior Art
FIG. 2 is a schematic illustration of a counterweight of an elevator system that can incorporate embodiments of the present disclosure.

For example, as shown in FIG. 2, a counterweight 200 is located within a pit 202 of an elevator shaft, the pit 202 having a floor 204 and a wall 206. As shown, a guide rail 209 is mounted to the floor 204, and may also be mounted or fixedly connected to a wall of the elevator shaft, as will be appreciated by those of skill in the art. The counterweight 200 is suspended from a roping 207 that can be operably connected to an elevator car, as known in the art.

At times, a mechanic may need to access the pit 202 to perform various maintenance and/or inspection operations. To protect the mechanic and other components that are within the pit 202, a counterweight guard 208 can be positioned within the pit 202. In the present illustration, the counterweight guard 208 can be fixedly attached to and positioned between guide rails 209 of the elevator system, however, such positioning and mounting is not limiting.

One requirement of an elevator system may be maintaining a minimum counterweight clearance distance 210. The minimum counterweight clearance distance 210 is a minimum distance that the counterweight 200 must stop at maximum extension of the roping 207. That is, the minimum counterweight clearance distance 210 is a distance from the floor 204 of the pit 202 that the counterweight 200 must be maintained when the elevator car is at its highest point in the elevator shaft and the counterweight 200 is at its lowest point. If the counterweight 200 extends beyond the minimum counterweight clearance distance 210 (e.g., approaches closer to the floor 204), the elevator system may require maintenance. To ensure that the counterweight 200 is properly stopping and maintaining the minimum counterweight clearance distance 210, a mechanic typically needs to enter the pit 202, which can be time consuming. Accordingly, it may be advantageous to provide automated monitoring and inspection of the counterweight 200.

Figure 3A:
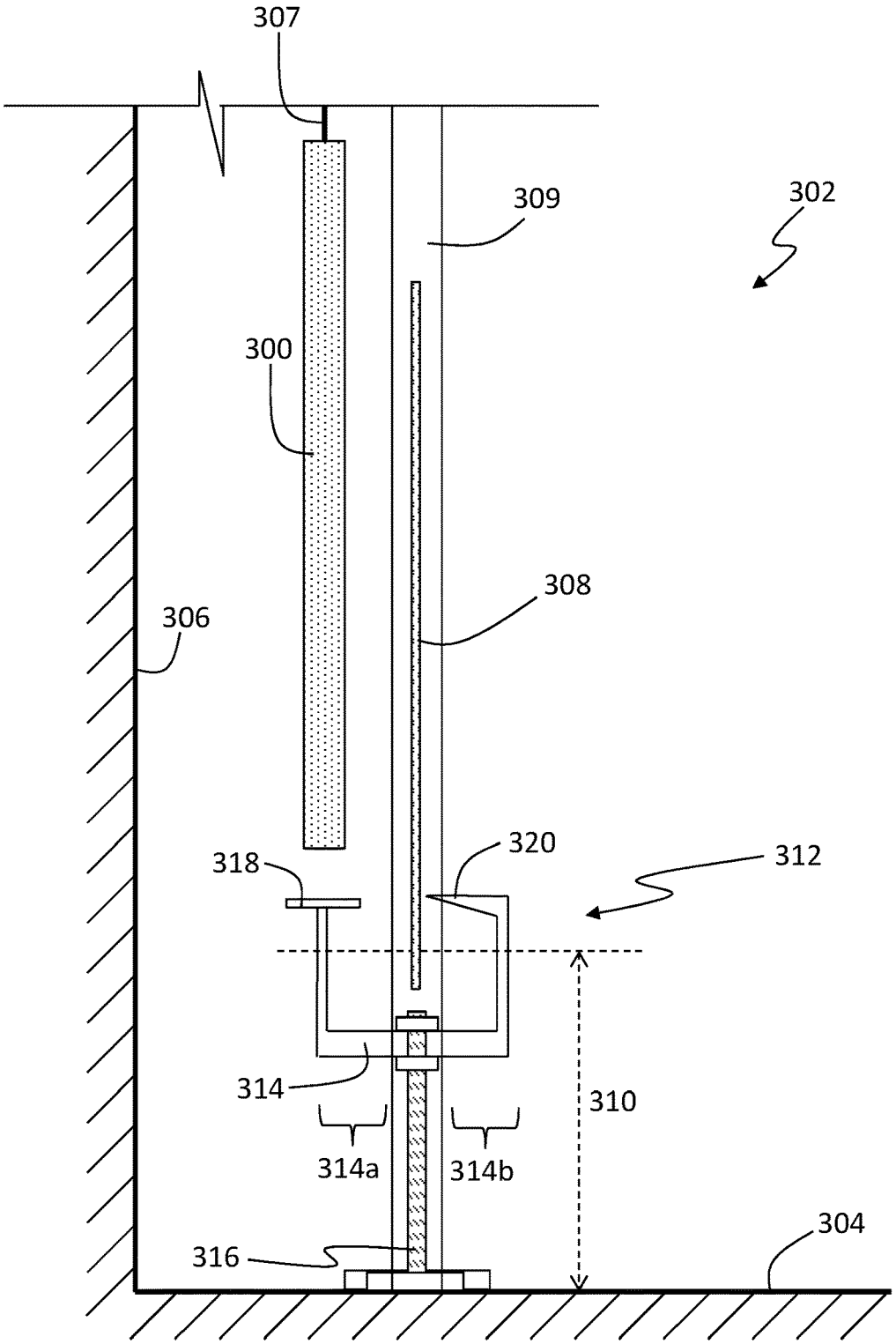
FIG. 3A is a side elevation schematic illustration of an elevator system having a counterweight inspection system in accordance with an embodiment of the present disclosure.
Figure 3B:
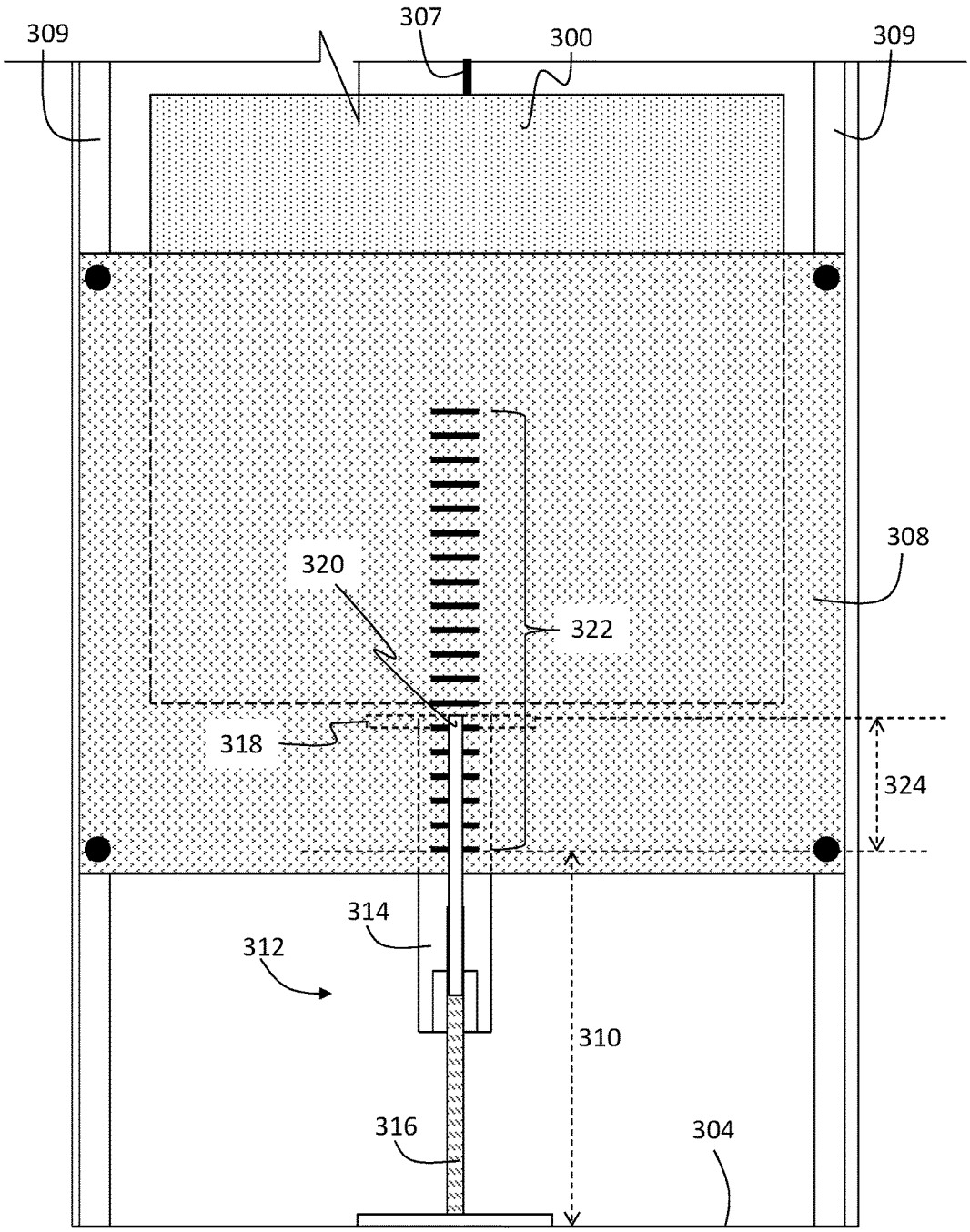
FIG. 3B is a front elevation schematic illustration of the elevator system of FIG. 3A.

Turning now to FIGS. 3A-3B, a portion of a counterweight inspection system 312 in accordance with an embodiment of the present disclosure is shown. FIG. 3A is a side elevation illustration and FIG. 3B is a front elevation illustration. As shown, the portions of the counterweight inspection system 312 illustrated in FIGS. 3A-3B are positioned within a pit 302 of an elevator system. As shown, a counterweight 300 is suspended from a roping 307, similar to that shown and described above, with the counterweight 300 movable relative to a floor 304 of the pit 302. A counterweight guard 308 is mounted to guide rails 309 of the elevator system and positioned such that the counterweight 300 is located between the counterweight guard 308 and a wall 306 of the elevator shaft.

The counterweight inspection system 312 can provide an automated (and remote) inspection system for inspecting the distance of travel of the counterweight 300 within the elevator shaft, and specifically a system for measuring a distance from a floor 304 of the pit 302. As shown, the counterweight inspection system 312 includes a movable frame 314. The movable frame 314 is substantially U-shaped such that a portion of the movable frame 314 is located on a first side 314*a* of the counterweight guard 308 and another portion of the movable frame 314 is located on a second side 314*b* of the counterweight guard 308. The first side 314*a* is the same side as the counterweight 300, and is thus located between the counterweight guard 308 and the wall 306. The second side 314*b* is a side opposite the first side 314*a*. The movable frame 314 is movable along a support frame 316.

The first side 314*a* of the movable frame 314 includes a contact surface 318 that is configured to be contacted and receive a force from the counterweight 300. The contact surface 318 is formed to receive the counterweight 300 and when force is applied by the counterweight 300 to the contact surface 318 the movable frame 314 may be moved vertically along the support frame 316. When the force applied by the counterweight 300 ceases to be applied, the position of the movable frame 314 is halted and thus can represent an extent of movement of the counterweight 300.

On the second side 314*b* of the movable frame 314, the movable frame 314 includes a marker 320. The marker 320 is used to indicate a position on an indicator element 322 (as shown in FIG. 3B). The indicator element 322 is located on the counterweight guard 308. The indicator element 322 can be painted on the counterweight guard 308 and can include various colors or other types of indicators to indicate a distance of travel of the counterweight 300. In other embodiments, the indicator element 322 can be mounted to or otherwise attached to the counterweight guard 308. For example, in some embodiments, the indicator element 322 can be a scale or other indicator that is on a plate or similar structure that is magnetically attachable to the counterweight guard 308. In other embodiments, fasteners such as screws, bolts, nails, adhesives, etc. can be used to mount the indicator element 322 to the counterweight guard 308.

In some embodiments, the marker 320 can be a pointer or other extension of the movable frame 314 that when viewed by a detector, as described herein, a determination of the maximum position of travel of the counterweight 300 can be made. The indicator element 322 and the marker 320 can be viewed to determine if the counterweight is exceeding a minimum counterweight clearance distance 310, and thus extending too close to the floor 304 of the pit 302. Further, indicator element 322 and the marker 320 can be viewed to determine a current maximum extent of travel of the counterweight 300 to determine if maintenance should be performed prior to the minimum counterweight clearance distance 310 being exceeded. Accordingly, as shown in FIG. 3B, an operational counterweight clearance distance 324 can be inspected. The operational counterweight clearance distance 324 may be a clearance distance that is greater than the minimum counterweight clearance distance 310, as schematically shown in FIG. 3B. Thus, the minimum counterweight clearance distance 310 plus the operational counterweight clearance distance 324 may be a total distance of separation of the counterweight 300 from the floor 304 during maximum extension of the roping 307 attached to the counterweight 300.

Although shown in FIGS. 3A-3B with the indicator element 322 located on the counterweight guard 308, such arrangement is not to be limiting. For example, in some embodiments, the indicator element can be part of, mounted to, or otherwise positioned relative to a wall of the elevator pit. Such embodiments may be employed, for example, when no counterweight guard is present or when the counterweight guard is not arranged such that the example installation shown in FIGS. 3A-3B is possible.

Figure 4:
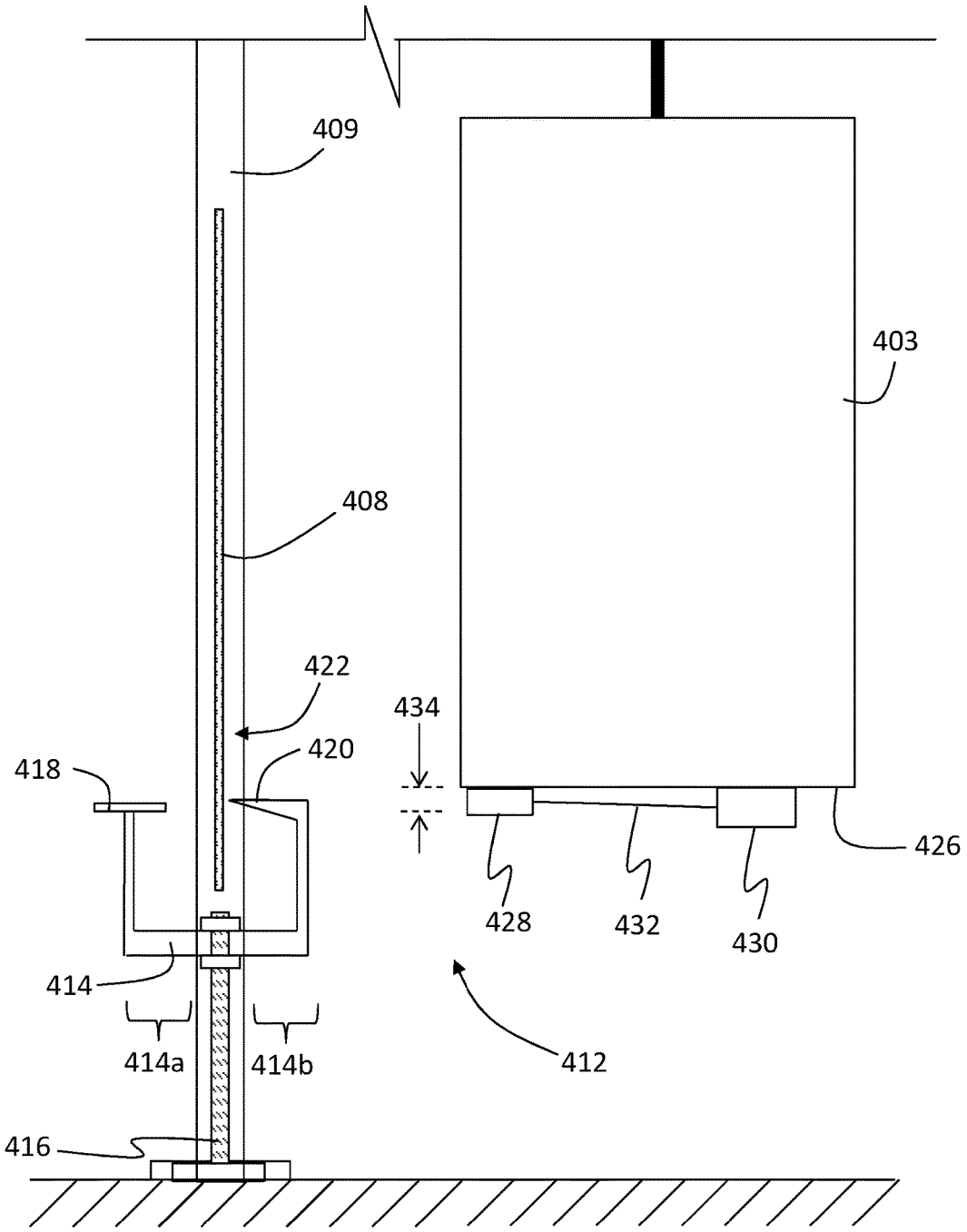
FIG. 4 is a side elevation schematic illustration of an elevator system having a counterweight inspection system in accordance with an embodiment of the present disclosure.

Turning now to FIG. 4, a schematic illustration of a counterweight inspection system 412 in accordance with an embodiment of the present disclosure is shown. FIG. 4 schematically illustrates an elevator car 403 with a portion of the counterweight inspection system 412 installed on a bottom 426 of the elevator car 403, including a detector 428. The detector 428 is arranged to view an indicator element 422 and marker 420, similar to that shown and described above, that is part of or on a counterweight guard 408 that is mounted in a pit of an elevator shaft and to one or more guide rails 409. The counterweight inspection system 412 includes a system and configuration similar to that described above, including a movable frame 414 that is movable along a support frame 416 in response to a counterweight interacting with a contact surface 418. The contact surface 418 of the movable frame 414 is located on a first side 414*a* of the movable frame 414 and a marker 420 is on a second side 414*b* of the movable frame 414.

The portion of the counterweight inspection system 412 on the elevator car 403 includes the detector 428, a control unit 430, and a communication connection 432 enabling communication between the detector 428 and the control unit 430. The control unit 430 can be a computer or other electronic device that can send commands to and receive data from the detector 428. In some embodiments, the control unit 430 can receive output from the detector 428 (e.g., images). The communication connection 432 can be a physical line or wire or can be a wireless communication connection, as will be appreciated by those of skill in the art. Further, although shown with the control unit 430 and the detector 428 located on the bottom 426 of the elevator car 403, such arrangement is not to be limiting. For example, in some embodiments, the control unit and/or the detector can be part of an elevator controller or other electronics associated with other parts or components of the elevator system and/or may be located permanently in the pit of the elevator shaft. Further, in some embodiments, the control unit may be located remote from the elevator car. In some embodiments, the control unit may be part of a general purpose computer that is configured to enable maintenance, inspection, and/or monitoring of the elevator system.

The detector 428 is arranged to view the state of the marker 420 relative to the indicator element 422 by detecting a position of the marker 420 relative to the indicator element 422 that is part of and/or applied to the counterweight guard 408. The detector 428 is positioned and calibrated such that the detector 428 can detect the presence of the marker 420 and the indicator element 422 within an inspection region 434. As shown, the inspection region 434 is defined as a space or zone aligned to a portion of the counterweight guard 408 that is includes the marker 420 and at least a portion of the indicator element 422. The inspection region 434 is selected to be able to determine the position of the marker 420 relative to a section or indicator of the indicator element 422 and thus determine a position of maximum movement of the counterweight of the elevator system. The control unit 430 (or a portion of the detector 428 depending on electronic configuration) will perform image analysis of the inspection region 434 to determine a distance of travel of the counterweight based on a position of the marker 420 of the movable frame 414.

The detector 428 (and/or the control unit 430) is configured to detect and determine the extent of movement of the counterweight by viewing the marker 420 and the indicator element 422 on the counterweight guard 408. The indicator element of embodiments of the present disclosure can take various forms. For example, in some embodiments, the indicator element 422 can be a colored paint that has contrast with the color or texture of the counterweight guard 408. In such embodiments, the detector 428 can be an optical sensor (e.g., a camera) that is arranged to detect, at least, the presence of the colored paint of the indicator element 422 applied to the counterweight guard 408. In other embodiments, the indicator element 422 can be a reflective or refractive surface, texture, or coating that is applied to or part of the counterweight guard 408 and the detector 428 can be appropriately configured. For example, with a reflective surface indicator element 422, the detector 428 can include a light source that projects light toward the reflective indicator element 422. The detector 428 further includes, in such arrangements, a sensor that can detect if any light is reflected from the reflective indicator element 422. In some embodiments, the indicator element 422 can be a textured surface or other surface feature of the counterweight guard 408 that can be detected by the detector 428.

Further still, in some embodiments, the indicator element 422 can be a coating that is applied and detectable by the detector 428 of the counterweight inspection system 412. Moreover, in some embodiments, the detector 428 and/or the indicator element 422 can be selected to operate at (and/or react to) a specific wavelength or range of wavelengths. Those of skill in the art will appreciate that various other types of detectors and/or indicator elements can be employed without departing from the scope of the present disclosure. In some embodiments, the indicator element 422 can include text, numbers, letters, or other types of indicators that may indicate a distance. Further, in some embodiments, the indicator element 422 can include graphical elements or features to aid in the analysis of the distance of travel of the counterweight.

In operation, in one non-limiting example, such as an automated inspection operation, depending on the portion of the indicator element 422 that is detected by the detector 428 and indicated by the marker 420 within the inspection region 434, the control unit 430 will determine that the counterweight is properly functioning and in compliance with preset conditions and/or requirements. However, if the marker 420 indicates a different portion of the indicator element 422 within the inspection region 434, the control unit 430 will determine that the counterweight is malfunctioning or traveling beyond the minimum counterweight clearance distance, is not in compliance with preset conditions or requirements, is damaged, and/or is missing entirely. In such an instance, the control unit 430 can generate an error notification or other message that can be used to indicate that maintenance is required on the counterweight of the elevator system.

Figure 5:
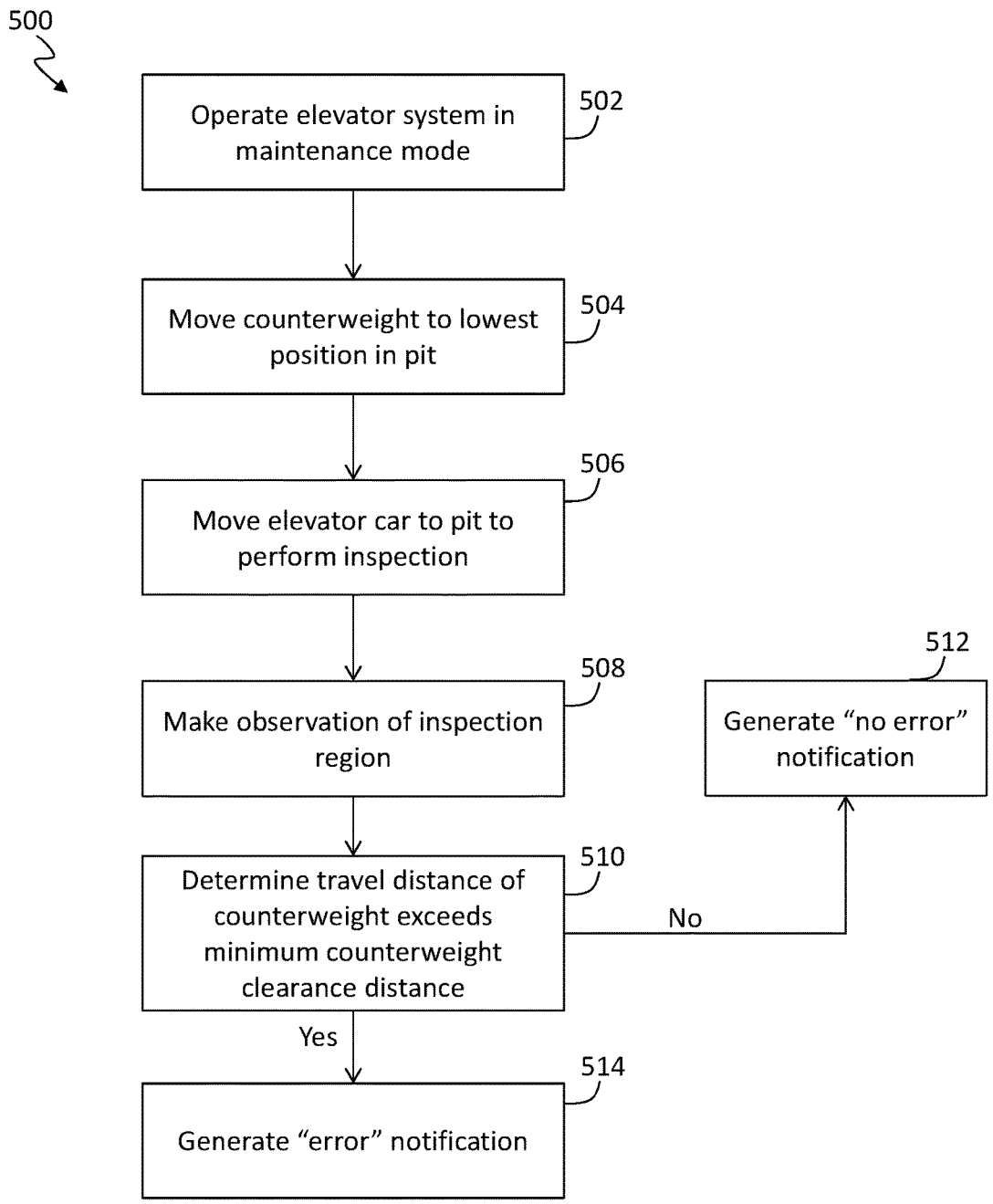
FIG. 5 is a flow process for performing counterweight inspections in accordance with an embodiment of the present disclosure.

Turning now to FIG. 5, a flow process 500 for performing an automated counterweight travel inspection is shown. The counterweight travel inspection can be performed using an elevator system as shown and described above, having a counterweight inspection system (e.g., control unit, detector, marker, indicator element, etc.) and an elevator car and counterweight movable within an elevator shaft. The counterweight travel inspection can be initiated by a mechanic or other person when it is desirable to determine the status of travel of the counterweight in the pit of the elevator system. Such inspection can be performed when an elevator system is first installed within a building and/or may be performed at various times after installation, such as to monitor the counterweight travel distance on a regular maintenance schedule.

For example, the inspection could be automatically performed in an inspection run of the elevator through the elevator shaft on an hourly basis, daily basis, weekly basis, monthly basis, or at any other predetermined interval. In some embodiments, the inspection may be automatically performed every time the elevator stops at a landing. In some embodiments, the inspection may be automatically triggered by a customer complaint. In some embodiments, the inspection may be triggered remotely (e.g., by a remote computer system) or onsite by a mechanic. In one embodiment, the inspection may be triggered automatically in advance of a scheduled maintenance visit by a mechanic to the elevator installation and the results may be sent automatically to the mechanic in advance or saved in the elevator controller for the mechanic to download.

At block 502, the elevator system can be operated in a maintenance mode of operation. The operation within maintenance mode can be optional and in some embodiments, the flow process 500 (omitting block 502) can be performed during normal operation of the elevator system. In embodiments wherein the maintenance mode is activated, such activation can be manual or automatic. For example, in an example of manual operation, a mechanic or technician can use a control element to run the elevator system in maintenance mode to perform inspection or other maintenance operations while the mechanic or technician is present. In other embodiments, the maintenance mode of operation can be automatically activated, such as through an elevator controller or control unit that is programmed to perform automatic inspection and monitoring of various components of the elevator system.

At block 504, the counterweight of the elevator system is moved to a lowest position of travel within the pit of the elevator system. In such operation, the elevator car can be moved to the highest position within the elevator shaft. The counterweight will interact with a portion of the counterweight inspection system, such as a movable frame or portion thereof, to move the movable frame along a support frame.

At block 506, the elevator car is moved to the pit or lowest position within the elevator shaft to inspect an inspection element and marker of the counterweight inspection system. The movement of the elevator car can be controlled by a control unit to move within the elevator shaft at a maintenance speed of operation that may be slower than a normal operation speed. Such reduced speed can be beneficial for performing landing door gib inspections in accordance with the present disclosure, although such reduced speeds are not required in all embodiments.

At block 508, a detector is used to observe an inspection region, such as shown and described above, including a marker and indicator element. The detector can be an optical detector or other sensor or device that can detect a marker of the movable frame and an indicator element that is on a counterweight guard, as shown and described above. The observation can be a picture or snapshot that is taken at a predetermined position to enable proper detection of the marker and indicator element in the inspection region. In some embodiments, the observation can be a video, continuous image capture/detection, and/or a series of image captures or detections.

At block 510, the detector and/or a control unit will analyze the observation made at block 508 to determine the position of the marker relative to the indicator element in the inspection region. In some embodiments, the analysis may be digital and/or image analysis to determine if an error (e.g., damage) exists with respect to the counterweight movement made at block 504. The analysis can be performed on an output of the detector. At block 510, the analysis will determine a distance of travel of the counterweight, and a determination can be made with respect to a minimum counterweight clearance distance, as described above.

If the marker and indicator element indicate a distance of travel that does not exceed the minimum counterweight clearance distance, the flow process 500 can end or can proceed to block 512 and generate a no error notification. When an appropriate travel distance (e.g., not exceeding the minimum counterweight clearance distance), such no error notification can be provided to inform a mechanic or technician that the counterweight is in compliance with desired operation and/or can be used for generating an inspection history. As such, if no error is detected, a counterweight inspection system of the present disclosure can be configured to operate in various predetermined ways, without departing from the scope of the present disclosure.

If, at block 510, it is determined that the marker and indicator element within the inspection region exceeds the minimum counterweight clearance distance, the flow process 500 continues to block 514. At block 514, the control unit (or other component) generates an error notification to indicate that there is an error with the counterweight. In some embodiments, if an error message or error notification is generated, the control unit can limit the operation of the elevator system such that a specific elevator speed of travel cannot be exceeded until a "no error" is achieved (e.g., repair of the counterweight or roping, etc.). Upon receiving an error notification or indication, a mechanic can perform a maintenance operation to fix and/or replace the counterweight or associated roping. After completing the maintenance operation, the system can run the flow process 500 again to determine if the maintenance operation corrected the error with the counterweight. In some embodiments, in addition to a pass/fail determination, an image of the marker and indicator element may be saved and sent to a mechanic.

Those of skill in the art will appreciate that various example embodiments are shown and described herein, each having certain features in the particular embodiments, but the present disclosure is not thus limited. That is, features of the various embodiments can be exchanged, altered, or otherwise combined in different combinations without departing from the scope of the present disclosure.

For example, in another example, the detector can capture images that are transmitted to a display for manual inspection. In such embodiments, a mechanic can initiate an inspection operation, similar to flow process 500, but the flow process does not include blocks 510-514. Instead, captured images are transmitted to a display, either onsite or offsite, for inspection and analysis by a human (mechanic, analyst, etc.) and/or for automated and/or digital (computerized) inspection. When errors (e.g., improper travel of the counterweight) are detected, reports can be generated to indicate maintenance is required.

After operation (e.g., moving counterweight and capturing an image), the position of the marker can be reset. Such resetting can be manual or automatic. In some non-limiting embodiments, various components of the inspection systems can be biased to reset automatically, such as the movable frame 314 and/or a portion of the support frame 316, shown in FIGS. 3A-3B. In some embodiments, the resetting may occur when the movement of the movable frame has reached a predetermined position. In some embodiments, the resetting may occur after a calibration or maintenance operation performed on the counterweight (e.g., manually or automatically).

Advantageously, embodiments described herein provide automated inspection of elevator counterweight travel. The automation can be manually implemented and yet not require a technician to enter an elevator shaft, or can be fully automated as described herein.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator system comprising:

an elevator car within an elevator shaft;

a counterweight within the elevator shaft and operably connected to the elevator car;

an indicator element located in a pit of the elevator shaft; and an inspection system comprising:

a detector located on the elevator car and arranged to detect a location of the counterweight in an inspection region within the pit based a relative position between the counterweight and the indicator element; and a movable frame having a marker that is movable in response to interaction with the counterweight, the marker located proximate the indicator element.

2. The elevator system of claim 1, further comprising a counterweight guard located in the pit of the elevator shaft, the counterweight guard having the indicator element located thereon.

3. The elevator system of claim 1, wherein the movable frame comprises a first side and a second side, wherein the inspection system comprises a contact surface on the first side, wherein the contact surface is arranged to interact with the counterweight and the marker is located on the second side.

4. The elevator system of claim 1, wherein a relative position of the marker and the indicator element indicates a distance of travel of the counterweight.

5. The elevator system of claim 1, the inspection system further comprising a support frame upon which the movable frame moves.

6. The elevator system of claim 1, further comprising a control unit in communication with the detector and configured to:

analyze an output of the detector;

determine if the counterweight has an error; and generate an error notification when an error in the counterweight is determined.

7. The elevator system of claim 1, wherein the detector captures images of the indicator element for inspection.

8. The elevator system of claim 1, wherein the indicator element is at least one of a colored paint, a textured surface, or a reflective surface of at least one an elevator shaft wall or a counterweight guard.

9. The elevator system of claim 1, wherein the detector is located on an exterior of the elevator car.

10. The elevator system of claim 1, wherein the indicator element is arranged to determine if the counterweight exceeds a minimum counterweight clearance distance.

11. A method for inspecting a counterweight of an elevator system comprising:

moving a counterweight to a lowest position within an elevator shaft;

observing an inspection region using a counterweight inspection system having a detector located on an exterior of an elevator car, the inspection region being a region including an indicator element;

determining if an error exists with the counterweight based on the indicator element within the inspection region; and generating an error notification when an error in the counterweight is determined, wherein the inspection system includes a movable frame having a marker positioned relative to the indicator element, wherein the movable frame comprises a first side and a second side, wherein the inspection system comprises a contact surface on the first side, wherein the contact surface is arranged to interact with the counterweight and the marker is located on the second side.

12. The method of claim 11, further comprising analyzing, with a control unit, an output of the detector.

13. The method of claim 11, wherein the indicator element is mounted to at least one of a counterweight guard or wall of the elevator shaft.

14. The method of claim 11, further comprising capturing images of the marker and the indicator element for inspection.

15. The method of claim 11, wherein the indicator element is at least one of a colored paint, a textured surface, or a reflective surface of at least one an elevator shaft wall or a counterweight guard.

16. The method of claim 11, wherein the detector is located on a bottom of the elevator car.

17. The method of claim 11, wherein a relative position of the marker and the indicator element indicates a distance of travel of the counterweight.

18. The method of claim 11, wherein the indicator element is arranged to determine if the counterweight exceeds a minimum counterweight clearance distance.

* * * * *